United States Patent [19]

Marcus

[11] Patent Number: 5,072,724

[45] Date of Patent: Dec. 17, 1991

[54] VIBRATIONAL LIQUID-WAVE STIMULATING THERAPY MASK APPARATUS FOR FACIAL HEALTH AND BEAUTY CARE

[76] Inventor: Joseph Marcus, 1507 36th Ave., Moline, Ill. 61265

[21] Appl. No.: 617,349

[22] Filed: Nov. 23, 1990

[51] Int. Cl.[5] ..... A61H 9/00

[52] U.S. Cl. ..... 128/66; 128/32; 128/24.1; 128/64

[58] Field of Search ..... 128/24.1, 32, 36, 38, 128/64, 65, 66

[56] References Cited

U.S. PATENT DOCUMENTS

| | | | |
|---|---|---|---|
| 1,965,424 | 7/1934 | Mascolo . | |
| 2,882,892 | 4/1959 | Kosior | 128/62 R |
| 3,088,459 | 5/1963 | Rabinoff | 128/66 |
| 3,323,517 | 6/1967 | Keller | 128/41 X |
| 3,478,736 | 11/1969 | Roberts . | |
| 3,557,781 | 1/1971 | Kaye | 128/32 X |
| 4,052,981 | 10/1977 | Bachmann . | |
| 4,125,112 | 11/1978 | Weihs . | |
| 4,223,668 | 9/1980 | Forget nee Lamy et al. | 128/66 |
| 4,343,303 | 8/1982 | Williams . | |
| 4,574,787 | 3/1986 | Jacobs | 128/64 |
| 4,732,140 | 3/1988 | Stoffregen . | |
| 4,787,372 | 11/1988 | Ramseyer | 128/62 R X |
| 4,841,954 | 6/1989 | Kalsi | 128/36 |

FOREIGN PATENT DOCUMENTS

| | | |
|---|---|---|
| 2520535 | 11/1976 | Fed. Rep. of Germany . |
| 943452 | 3/1949 | France . |
| 2285115 | 4/1976 | France . |
| 233074 | 2/1986 | German Democratic Rep. . |
| 839536 | 6/1981 | U.S.S.R. . |
| 984476 | 1/1983 | U.S.S.R. . |

*Primary Examiner*—Robert A. Hafer
*Assistant Examiner*—Brian E. Hanlon
*Attorney, Agent, or Firm*—Thomas I. Rozsa

[57] ABSTRACT

The present invention is a vibrational liquid-wave stimulating therapy mask apparatus for facial health and beauty care comprising a mask and a vibrating means. The mask is configured to substantially conform the general facial contour of a human face and completely cover the entire face of a user with openings corresponding to the respective locations and sizes of the eyes, nose and mouth of the user. The mask has an interior forming a layer shaped cavity inflated with liquid capable of transmitting vibrational waves, and an exterior having an outward side and an inward side with a very smooth surface contacting the entire area of the user's face. The vibration generated by the vibrating elements connected to the outward side of the exterior of the mask is transmitted by the liquid contained within the layer shaped cavity in the form of liquid waves to the inward side and slightly damped, then through the smooth surface of the inward side to stimulate the entire superficial blood capillary system of the user's face.

18 Claims, 1 Drawing Sheet

Fig. 1.
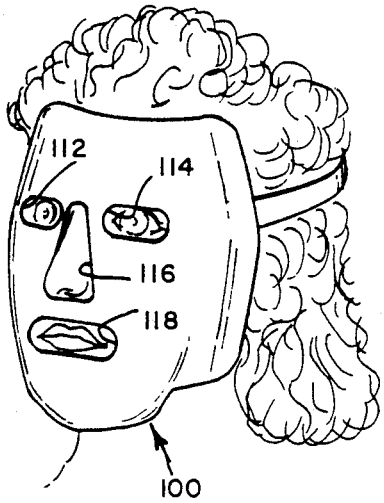
Fig. 2.
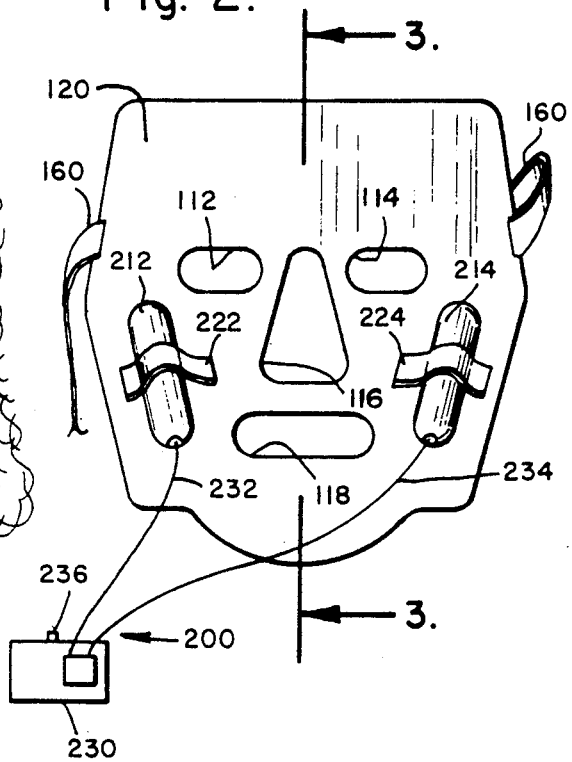
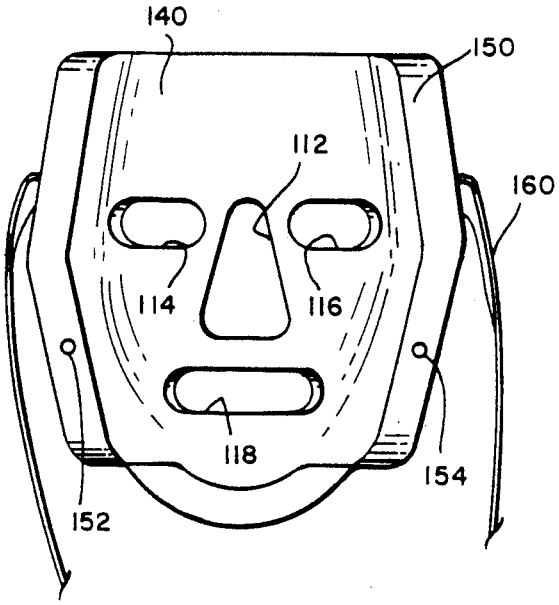
Fig. 4.
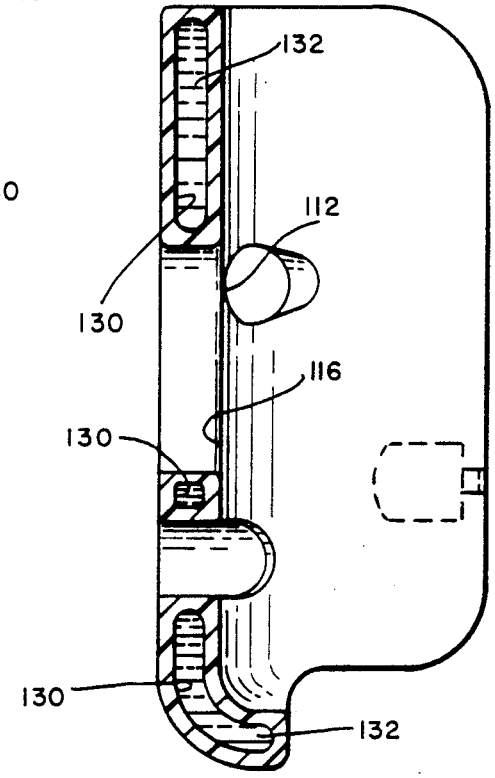
Fig. 3.

VIBRATIONAL LIQUID-WAVE STIMULATING THERAPY MASK APPARATUS FOR FACIAL HEALTH AND BEAUTY CARE

BACKGROUND OF THE INVENTION

1. Field of the Invention

The present invention relates to the field of medical treatment and general care apparatus for the human body and human skin. More particularly, the present invention relates to the field of vibrational apparatus for facial health and beauty care.

2. Description of The Prior Art

Many different types of human body and skin health and beauty care apparatus, especially vibrational therapy mask apparatus, have been introduced and produced in the prior art. The following is a list of the prior art patents representing the development in the most relevant areas:

1. U.S. Pat. No. 4,841,954 issued to Kalsi on June 27, 1989 for "Oculofacial Massager" (hereafter the "Kalsi Patent").

2. U.S. Pat. No. 4,732,140 issued to Stoffregen on Mar. 22, 1988 for "Vibratory Against Body With Belt Having Elastic Strap" (hereafter the "Stoffregen Patent").

3. U.S. Pat. No. 4,574,787 issued to Jacobs on Mar. 11, 1986 for "Acupressure Apparatus" (hereafter the "Jacobs Patent").

4. U.S. Pat. No. 4,343,303 issued to Williams on Aug. 10, 1982 for "Stimulating Apparatus" (hereafter the "Williams Patent").

5. U.S. Pat. No. 4,125,112 issued to Weihs on Nov. 14, 1978 for "Transmission Members For Electro-Vibratory Massage Appliances" (hereafter the "Weihs Patent").

6. U.S. Pat. No. 4,052,981 issued to Bachmann on Oct. 11, 1977 for "Massaging Method & Apparatus" (hereafter the "Bachmann Patent").

7. U.S. Pat. No. 4,046,142 issued to Whitney on Sept. 6, 1977 for "Beauty Paddle" (hereafter the "Whitney Patent").

8. U.S. Pat. No. 3,896,795 issued to Solhkhah on July 29, 1975 for "Vibrator Belt" (hereafter the "Solhkhah Patent").

9. U.S. Pat. No. 3,557,781 issued to Kaye on Jan. 26, 1971 for "Vibratory Facial Mask" (hereafter the "Kaye Patent").

10. U.S. Pat. No. 3,478,736 issued to Roberts et al on Nov. 18, 1969 for "Massage Device" (hereafter the "Roberts Patent").

11. U.S. Pat. No. 3,323,517 issued to Keller on June 6, 1967 for "Heating And Vibrating Device" (hereafter the "Keller Patent").

12. U.S. Pat. No. 1,965,424 issued to Mascolo on July 3, 1934 for "Facial Treatment Apparatus" (hereafter the "Mascolo Patent").

13. East German Patent No. 233,074 issued on Feb. 19, 1986 (hereafter the "East German Patent").

14. U.S.S.R. Patent No. 839,536 issued on June 23, 1981 (hereafter the "first U.S.S.R. Patent").

15. U.S.S.R. Patent No. 984,476 issued on Jan. 5, 1983 (hereafter the "second U.S.S.R. Patent").

16. West German Patent No. 25 20 535 issued on Nov. 25, 1976 (hereafter the "West German Patent").

17. French Patent No. 943,452 issued on Mar. 9, 1949 (hereafter the "first French patent").

18. French Patent No. 2,285,115 issued on Apr. 16, 1976 (hereafter the "second French Patent").

The following is a detailed review of the prior art patents listed above.

The Mascolo Patent discloses a facial treatment apparatus used for treating a person's face with heated steam through a thick towel. It comprises an electrically heated steam generator, a closed cup to contain medicament through which the steam passes, and a mask formed of flexible rubber for fitting over the person's face. The mask has a double wall with a steam space therebetween and the inner wall is perforated for passage of steam.

The Keller Patent discloses a heating and vibrating device used for administering combined heat treatment and vibratory massage to the head, neck and upper torso region of a person. It comprises a head and shoulder cover device containing heating elements as well as vibrating elements. The cover device of the Keller Patent is made of light, multi-layer fabric material having a serpentine network of resistance heating elements sewn within the layers of the fabric throughout its extent.

The Roberts Patent discloses a massage device used for massaging the temple areas of a person's head. It comprises a pair of temple massage units constructed to be worn on the person 's head in a manner similar to headphones and imparting the vibration to the temple areas for relieving simple tension and headache.

The Kaye Patent discloses a vibratory facial mask used for treating facial areas to improve skin complexion, tone, texture and firmness. It comprises a mask made of smooth, soft, resilient, foam-like material within which is fully embedded vibratory means for imparting vibrations to side facial areas and chin areas. It further comprises means for holding the mask and vibratory unit for imparting vibration to back neck portions.

The Solhkhah Patent discloses a vibrator belt used for providing a pulsating or vibratory motion against a wearer's body. It comprises a plurality of rotatable members linked together by a flexible rod and a drive means to rotate the rod which in turn revolves the rotatable members, causing the pulsating motion to be generated forward and back from the wearer's body.

The Whitney Patent discloses a beauty paddle used for stimulating the skin and blood circulation. It comprises a rotatable multiple blade paddle, a driving means such as an electronic motor, and a control means such as a switch.

The Bachmann Patent discloses a massage method and apparatus used for massaging particular portions of the body. It comprises, in one preferred embodiment, a face mask made out of a pliable member and having a plurality of compressible fingers mounted on the inward side of the face mask for contacting and massaging the face portion. The vibrations are generated by a plurality of coaxially arranged, separately energized motors.

The Weihs Patent discloses a transmission member for electro-vibratory massage appliances used for transmitting electro-vibration to massage a part of a human body. It comprises a fluid-filled member, preferably a rubber bag, having a closable aperture and a vibration portion which is either a mounting for a vibratory source or a permanently attached vibration source. Variations in the degree of vibrations transmitted may be achieved by providing a composite transmission means having two or more transmission members and more than one vibration source.

The Williams Patent discloses a stimulating apparatus for applying vibratory treatment to selected body regions, such as the cervical or lumbar regions to stimulate muscle activity in these regions. It comprises a single unit or two assembled units with a vibrating or stimulating device located on each side thereof. The body of the apparatus is formed of a flexible and resilient, substantially hard plastic material having an inner layer of soft, porous material.

The Jacobs Patent discloses an acupressure apparatus for applying vibrational pressure evenly to a plurality of preselected acupressure points on a shaded portion of a living body such as upon the face. It comprises, in one preferred embodiment, a mask housing and a flexible membrane secured to the mask housing to form an enclosed chamber for containing fluid, and a plurality of protrusions carried on the flexible membrane. The vibration is evenly transferred to the plurality of protrusions which in turn exert vibrational pressure on the plurality of preselected acupressure points.

The Stoffregen Patent discloses a vibratory massager retained against the body with a belt having an elastic strap used for therapeutic exercises. It comprises several belts of varying sizes, to which one or two vibrator units can be releasably attached for use on various parts of a wearer's body. It further comprises an elastic band on each belt to press the vibratory unit firmly against the belt web when the belt is tightened so as to prevent irritation-producing movement between the belt and the wearer's skin.

The Kalsi Patent discloses an oculofacial massager for simultaneously providing a massaging action to the eye, nose and temple areas of a wearer. It comprises a contoured frame contacting the wearer's face and a vibration generating device providing vibration to the frame which is transmitted to the facial muscles contacting the frame.

The first French Patent discloses a facial mask used for massaging and strengthening the facial muscles. It is not a vibrational apparatus.

The second French Patent discloses a vibratory muscular treatment apparatus used for massaging the upper facial areas around the eyes. The apparatus is shaped like a frame of a part of eyeglasses which merely massages areas around the eyes, but not the whole facial area.

The West German Patent disclose a partial or complete facial massage mask with one or more oscillators built into handles attached to the mask. The vibration is imparted to the facial area by the mask which is totally made of solid state materials.

The first U.S.S.R. Patent discloses a muscle massage apparatus used for providing vibrations in areas of projections of bone, or near to where tendons of muscle to be treated are attached to increase he strength of the skeletal muscles and restoring their function in hypotrophy or after intense muscular work. It is essentially a muscle therapy apparatus, rather than a facial health and skin care apparatus.

The second U.S.S.R. Patent discloses a vibratory apparatus used for reducing the length of time required for rehabilitation after a scoliosis operation. It performs the vibration treatment on the active skin zones of the plantar surface of the feet.

The East German Patent disclose a switching circuit for a type of sonic massage apparatus used for massaging the lungs or other bodily organs. It uses a sound generator to generate sound waves with certain frequency and loudness which in turn give vibratory massage to the lungs. It is not a skin massage apparatus, but rather an internal massage apparatus especially for bronchial-asthma treatment which clears the breathing passage of phlegm and/or other foreign bodies and treats cramp without the use of medicaments.

The overall review of the prior art patents provides the following conclusion. Some of them, such as the Mascolo Patent, the Whitney Patent and the first French Patent, are not vibrational but rather heating or rotational or other apparatus. Many of them, such as the Solhkhah Patent, the Weihs Patent, the Williams Patent, the Stoffregen Patent and the first and second U.S.S.R. patents, are not facial mask apparatus designed for facial care but rather a bag, belt or the like apparatus designed for other body parts such as neck, shoulders, upper arms, back or waist, thighs, calves and feet. Among the vibrational facial mask apparatus, some of them, such as the Roberts Patent, the Kalsi Patent, the second French Patent and the East German Patent, only impart vibrations to certain limited facial areas such as the eye, nose, ears and temple areas for special treatment purposes; some of them, such as the Bachmann Patent and the Jacobs Patent, impart vibration to the whole facial area but in a so-called "point-contact" manner where only a plurality of protrusions contact the facial skin for certain special treatment such as acupressure treatment.

As to the rest of the prior art patents, the Keller Patent, the Kaye Patent and the West German Patent, which comprise a vibrational facial mask imparting the vibration to the whole facial area in a "surface-contact" manner where the entire inward side of the mask contacts the facial skin smoothly, all of them are using solid state materials such as fabric materials, foam-like materials or plastic materials for their facial mask to distribute the vibration wave. The disadvantage of solid state material is that the frequency spectrum of the harmonic vibrational waves is narrowed by the physical size and shape of the solid state material, and the amplitudes of the harmonic vibration waves are not equal in different directions. Therefore, while many different types of facial care apparatus have been introduced and produced, there is still a strong desire to have a new type of therapy mask apparatus for facial health and beauty care which imparts vibration to the whole facial area in a "surface-contact" manner and uses materials other than solid state materials as transmitting media to broaden the frequency spectrum of the harmonic vibrational waves substantially and equalize the amplitude of the harmonic vibrational waves transmitted in different directions, so that the facial skin and muscle tissue are more gently and evenly stimulated.

SUMMARY OF THE PRESENT INVENTION

The present invention is a vibrational liquid-wave stimulating therapy mask apparatus for facial health and beauty care.

It is known that a vibrational therapy mask is a beneficial apparatus for facial health and beauty care because it provides and imparts vibrational waves to the contacting facial skin to stimulate the facial skin and muscle tissue therefore improving skin complexion, tone, texture and strengthening muscle firmness.

It has been discovered, according to the present invention, that there are two major factors in human facial health and beauty care. One major factor is the sufficiency of the blood supply of the superficial blood capillary system of the face. The other major factor is the efficiency of the blood circulation of the superficial blood capillary system of the face. If the superficial blood capillary system provides sufficient blood supply and efficient blood circulation to facial skin and muscle tissue of the whole face, especially the blood deficient areas, then the natural superficial oxygenating, reinvigorating and rejuvenating functions will be enhanced to retain and restore the skin radiance, resilience and smoothness as well as the muscle firmness.

It has also been discovered, according to the present invention, that a vibrational therapy mask must have three essential features to reach a supreme stimulating effect upon the superficial blood capillary system of the face and achieve the ultimate therapeutic benefit of the facial health and beauty care. The three necessary features are: (1) the therapy mask must be specially designed to have an inward side which substantially conforms to the contour of a human face and completely covers the entire area of the face; (2) the inward side of the therapy mask must have a smooth and resilient surface so that the surface of the inward side of the therapy mask and the face fit together in a smooth "surface-contact" manner; and (3) the therapy mask must be able to broaden the frequency spectrum of the vibration wave generated by a vibrational source means, and transmit the vibrational wave in all directions with equalized amplitude so the therapy mask gently and evenly stimulates the facial skin and muscle tissue of the entire face.

It has further been discovered, according to the present invention, that if the vibrational therapy mask is specially constructed with an interior cavity inflated with liquid, then the vibration generated by the source means at the outward side of the exterior surface is imparted to the liquid media in the interior cavity and causes vibrational liquid waves. The liquid waves transmitted in liquid state materials have many distinctive differences compared to the waves transmitted in the solid state materials because liquid state materials have much looser structure. The liquid waves have a broader frequency spectrum and equalized amplitudes in different directions. When the vibrational liquid waves impart through the inward side surface onto the contacting face, the facial skin and muscle tissue and the superficial body fluids among the entire area of the face in various structures, status and situations are all stimulated consistently by the broad spectrum of frequencies and the equalized amplitudes.

It is therefore an object of the present invention to provide a vibrational therapy mask apparatus for facial health and beauty care which stimulates the superficial blood capillary system so that it can provide sufficient blood supply and efficient blood circulation to facial skin and muscle tissue of the whole face, especially the blood deficient areas, which in turn enhances the natural superficial oxygenating, reinvigorating and rejuvenating functions to retain and restore the skin radiance, resilience and smoothness as well as the muscle firmness.

It is also an object of the present invention to provide a vibrational therapy mask apparatus for facial health and beauty care that is specially designed to have an inward side substantially conformed to the contour of a human face and that completely covers the entire area of the face so the surface of the inward side of the mask can perfectly fit the whole surface of the face.

It is an additional object of the present invention to provide a vibrational therapy mask apparatus for facial health and beauty care which has a smooth and resilient surface on the inward side of the therapy mask so that the inward side of the therapy mask and the face fit together in a smooth "surface-contact" manner.

It is a further object of the present invention to provide a vibrational therapy mask apparatus for facial health and beauty care which is specially constructed with an interior cavity inflated with liquid so that the vibration generated by the source means at the outward side of the exterior surface is imparted to the liquid media in the interior cavity and causes vibrational liquid waves, which in turn imparts through the inward side surface onto the contacting face to stimulate the facial skin and muscle tissue with a broadened spectrum of frequencies and equalized amplitudes.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 1 is a perspective view of the present invention therapy mask as worn on a user's face.

FIG. 2 is a front elevational view of the outward side of the present invention therapy mask.

FIG. 3 is a cross-sectional view taken along line 3—3 of FIG. 2.

FIG. 4 is a rear elevational view of the inward side of the present invention therapy mask.

DETAILED DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope and contemplation of the invention as further defined in the appended claims.

Referring to FIG. 1, there is shown a perspective view of the present invention therapy mask 100 as worn on a user's face. Therapy mask 100 is configured to the overall facial features of the user's face. Mask 100 has a pair of openings 112 and 114 corresponding to the respective locations of the user's right and left eyes, as well as an opening 116 and an opening 118 corresponding to the respective locations of the user's nose and mouth, so that the user can see and breathe. Mask 100 may be designed in a multiplicity of different sizes, shapes and styles so a respective mask can conform as closely as possible to the particular facial features of different types of individuals. Mask 100 is made of lightweight, flexible and elastic materials. By way of example, mask 100 may be made of neoprene material on any other synthetic or natural elastic material.

Referring to FIG. 2, there is shown a front elevational view of the outward side 120 of exterior of mask 100 and a vibrating means 200. Vibrating means 200 comprises two vibrators 212 and 214 attached to outward side 120 of mask 100 by attaching members 222 and 224 respectively at locations approximately corresponding to the user's cheekbones. Vibrators 212 and 214 are two small electric oscillators energized by a portable power unit 230 through connecting cords 232 and 234 respectively. The user can turn the power on or off by using a switch 236 on power unit 230. By way of example, vibrators 212 and 214 may generate sonic vibrations with frequencies in the range of about 10 Hertz to 60 Hertz. It is also possible to incorporate ultrasonic frequency oscillators into the present invention. Power unit 230 is compact in size and light in weight so it can be conveniently carried or placed on a belt worn by the user. By way of example, power unit 230 may be a rechargeable battery unit.

FIG. 3 is a cross-sectional view of mask 100 taken along line 3—3 of FIG. 2. FIG. 3 illustrates that mask 100 is specially constructed so that its interior forms a cavity 130. Cavity 130 is configured as an extended layer which has almost the same size and shape as mask 100 but only is smaller. Cavity 130 is also fluid tight so it can be inflated with a non-toxic liquid 132 which is capable of transmitting sonic vibrations. By way of example, layer shaped cavity 130 is about ⅜ inch thick. The non-toxic liquid may be water, vegetable oil or hydraulic petroleum gasoline.

Referring to FIG. 4, there is shown a rear elevational view of the inward side 140 and the edge 150 of the exterior of mask 100, and a wearing means 160. It is very important that the surface of inward side 140 be smooth without any protrusions at all so that it can contact the user's face in a smooth "surface-contact" manner. Edge 150 is the exterior circumferential surface of mask 100 between outward side 120 and inward side 140. Because of the enclosing structure of interior cavity 130, edge 150 has certain thickness. By way of example, the average thickness of edge 150, which is also the average thickness of mask 100, is about ⅜ inch. On edge 150 there are two one-way apertures 152 and 154 which can be penetrated to inflate interior cavity 130 with liquid and closed or sealed fluid tight afterward. Wearing means 160 is attached to edge 150 at two remote locations and used by the user to wear mask 100 onto the face as shown in FIG. 1. Since mask 100 is lightweight, wearing means 160 can be a simple strap arrangement with various configurations which can be slipped over the user's head to hold mask 100 firmly against the user's face, such as a single elastic strap or a pair of belts with conventional fasteners. By way of example, wearing means 160 is a thin elastic strap extending behind the user's head and having its two ends respectively attached to two symmetric locations on edge 150 at about the same height as the eye openings.

The preferred embodiment of the present invention is a vibrational liquid-wave stimulating therapy mask apparatus used for facial health and beauty care. A user first wears mask 100 on the user's face by slipping elastic strap 160 over the user's head so that the surface of inward side 140 of the exterior of mask 100 is firmly against the user's face, but the user can still see and breathe through openings 112, 114, 116 and 118. When the user turns on switch 236 on battery unit 230, a pair of sonic oscillators 212 and 214 attached on the surface of outward side 120 of the exterior of mask 100 by attaching members 222 and 224 respectively are electrically energized by battery unit 230, and generate vibration on outward side 120 with sonic frequencies ranging from 10 Hertz to 60 Hertz. The vibration on outward side 120 is imparted to the liquid contained within interior cavity 130 of mask 100 and creates liquid waves with a broad spectrum of vibrational frequencies and equalized amplitudes in all directions. The liquid waves are transmitted through the liquid media and passed onto inward side 140 and slightly damped. The surface of inward side 140 smoothly contacts the user's whole face, so the vibration of inward side 140 stimulates the entire superficial blood capillary system of the user's face so that it can provide sufficient blood supply and efficient blood circulation to the facial skin and muscle tissue of the whole face, especially the blood deficient areas, which in turn enhances the natural superficial oxygenating, reinvigorating and rejuvenating functions to retain and restore the skin radiance, resilience and smoothness as well as the muscle firmness.

The present invention has three major distinctive features combined together, which are: (1) it is a facial mask specially designed to have an inward side which substantially conforms to the contour of a human face and completely covers the entire area of the face; (2) the inward side has a smooth and resilient surface so that the surface of the inward side of the therapy mask and the face fit together in a smooth "surface-contact" manner; and (3) it is constructed with an interior cavity inflated with liquid as a transmitting media to broaden the vibrational frequency spectrum and equalize the amplitudes of the vibrational waves in all directions. With these three major distinctive features the present invention can reach an ultimate stimulating effect upon the superficial blood capillary system of the user's entire face and achieve the ultimate therapeutic benefit of the facial health and beauty care.

Defined in detail, the present invention is a vibrational liquid-wave stimulating therapy mask apparatus for facial health and beauty care comprising: (a) a mask, a vibrating means and a wearing means; (b) said mask configured to substantially conform the general facial contour of a human face and completely cover the entire face of a user with openings corresponding to the respective locations and sizes of the eyes, nose and mouth of the user; (c) said mask having an interior and an exterior, where said interior forms a layer shaped cavity which is approximately ⅜ inch thick, and said exterior has an outward side, an edge which is approximately ⅜ inch thick and an inward side with a very smooth surface; (d) said layer shaped cavity inflated with liquid capable of transmitting vibrational waves; (e) said vibrating means including a pair of electric oscillators, a pair of mounting members, a pair of wires and a power unit with a switch, where the pair of electric oscillators is mounted on said outward side of the exterior of said mask by the pair of mounting members at respective locations corresponding to the cheekbone area of the face of the user, and connected to the power unit by the pair of wires respectively; and (f) said wearing means attached to said edge of the exterior of said mask at two opposite locations for holding said mask firmly against the face of the user such that said smooth surface of the inward side of the exterior of said mask is in smooth contact with the entire area of the face of the user; (g) whereby vibration generated by said pair of electric oscillators with sonic frequencies ranging from 10 Hertz to 60 Hertz is transmitted by said liquid contained within said layer shaped cavity in the form of liquid waves to said inward side and slightly damped, then through said smooth surface of the inward side to stimulate the entire superficial blood capillary system of the face of the user.

In one of the preferred embodiments of the present invention defined in detail, the mask is made of neoprene material, the power unit is a 3 volts rechargeable battery unit which can be composed of two 1½ volt batteries, the liquid is water, and the wearing means is an elastic strap which is approximately 1 foot long.

Defined broadly, the present invention is a vibrational liquid-wave stimulating therapy mask apparatus for facial health and beauty care comprising: (a) a mask, a vibrating means and a wearing means; (b) said mask configured to substantially conform the general facial contour of a human face and completely cover the entire face of a user with openings corresponding to the respective locations and sizes of the eyes, nose and mouth of the user; (c) said mask having an interior and an exterior, where said interior forms a layer shaped cavity, and said exterior has an outward side, an edge and an inward side with a very smooth surface; (d) said layer shaped cavity is inflated with liquid capable of transmitting vibrational waves; (e) said vibrating means including a pair of electric oscillators, a pair of mounting members, a pair of wires and a power unit with a switch, where the pair of electric oscillators is mounted on said outward side of the exterior of said mask by the pair of mounting members at respective locations corresponding to the cheekbone area of the face of the user, and connected to the power unit by the pair of wires respectively; and (f) said wearing means is attached to said edge of the exterior of said mask at two opposite locations for holding said mask firmly against the face of the user such that said smooth surface of the inward side of the exterior of said mask is in smooth contact with the entire area of the face of the user; (g) whereby vibration generated by said pair of electric oscillators is transmitted by said liquid contained within said layer shaped cavity in the form of liquid waves to said inward side and slightly damped, then through said smooth surface of the inward side to stimulate the entire superficial blood capillary system of the face of the user.

In an alternative embodiment of the present invention defined broadly, the mask is made of neoprene material, the power unit is a rechargeable battery unit, the liquid is vegetable oil or water, and the wearing means is an elastic strap.

Defined more broadly, the present invention is a vibrational liquid-wave stimulating therapy mask apparatus for facial health and beauty care comprising: (a) a mask, a vibrating means and a wearing means; (b) said mask configured to substantially conform to the general facial contour of a human face and completely cover the entire face of a user with openings corresponding to the respective locations and sizes of the eyes, nose and mouth of the user; (c) said mask having an interior and an exterior, where said interior forms a layer shaped cavity, and said exterior has an outward side, an edge and an inward side with a very smooth surface; (d) said layer shaped cavity is inflated with liquid capable of transmitting vibrational waves; (e) said vibrating means is connected to said outward side of the exterior of said mask; and (f) said wearing means is attached to said mask for holding said mask firmly against the face of the user such that said smooth surface of the inward side of the exterior of said mask is in smooth contact with the entire area of the face of the user; (g) whereby vibration generated by said vibrating means is transmitted by said liquid contained within said layer shaped cavity in the form of liquid waves to said inward side and slightly damped, then through said smooth surface of the inward side to stimulate the entire superficial blood capillary system of the face of the user.

In one of the preferred embodiments of the present invention defined more broadly, the mask is made of neoprene material, the liquid is water, and the wearing means is an elastic strap.

Defined most broadly, the present invention is a vibrational liquid-wave stimulating therapy mask apparatus for facial health and beauty care comprising: (a) a mask and a vibrating means; (b) said mask configured to substantially conform the general facial contour of a human face and completely cover the entire face of a user with openings corresponding to the respective locations and sizes of the eyes, nose and mouth of the user; (c) said mask having an interior and an exterior, where said interior forms a layer shaped cavity, and said exterior has an outward side and an inward side with a very smooth surface contacting the entire area of the face of the user; (d) said layer shaped cavity is inflated with liquid capable of transmitting vibrational waves; and (e) said vibrating means is connected to said outward side of the exterior of said mask; (f) whereby vibration generated by said vibrating means is transmitted by said liquid contained within said layer shaped cavity in the form of liquid waves to said inward side and slightly damped, then through said smooth surface of the inward side to stimulate the entire superficial blood capillary system of the face of the user.

In one of the preferred embodiments of the present invention defined most broadly, the mask is made of neoprene material and the liquid is water.

Of course the present invention is not intended to be restricted to any particular form or arrangement or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the invention might be embodied or operated.

The invention has been described in considerable detail in order to comply with the patent laws by providing full public disclosure of at least one of its forms. However, such detailed description is not intended in any way to limit the broad features or principles of the invention, or the scope of patent monopoly to be granted.

What is claimed is:

1. A vibrational liquid-wave stimulating therapy mask apparatus for facial health and beauty care comprising:

a. a molded unitary mask made of elastic material, a vibrating means and a wearing means;

b. said mask configured to substantially conform the general facial contour of a human face and completely cover the entire face of a user with openings corresponding to the respective locations and sizes of the eyes, nose and mouth of the user;

c. said mask having an interior layer shaped cavity and an exterior shell having an outward side, edge and inward side surrounding said interior shaped cavity, where said interior forms a layer shaped cavity having a uniform thickness, and said exterior has an elastic outward side, an edge having a uniform width and an inward side with a very smooth surface;

d. said layer shaped cavity is inflated with liquid capable of transmitting vibrational waves;

e. said vibrating means including a pair of electric oscillators, a pair of mounting members, a pair of wires and a power unit with a switch, where the pair of electric oscillators is mounted on said elastic outward side of the exterior of said mask by the pair of mounting members at respective locations corresponding to the cheekbone area of the face of the user, and connected to the power unit by the pair of wires respectively; and f. said wearing means is attached to said edge of the exterior of said mask at two opposite locations for holding said mask firmly against the face of the user such that said smooth surface of the inward side of the exterior of said mask is in smooth contact with the entire area of the face of the user;

g. whereby vibration generated by said pair of electric oscillators is transmitted by said liquid contained within said layer shaped cavity in the form of liquid waves to said inward side and slightly damped, then through said smooth surface of the inward side to stimulate the entire superficial blood capillary system of the face of the user.

2. The invention as defined in claim 1 wherein said mask is made of neoprene material.

3. The invention as defined in claim 1 wherein said power unit is a rechargeable battery unit.

4. The invention as defined in claim 1 wherein said liquid is water.

5. The invention as defined in claim 1 wherein said wearing means is an elastic strap.

6. A vibrational liquid-wave stimulating therapy mask apparatus for facial health and beauty care comprising:

a. a molded unitary mask made of elastic material, a vibrating means and a wearing means;

b. said mask configured to substantially conform the general facial contour of a human face and completely cover the entire face of a user with openings corresponding to the respective locations and sizes of the eyes, nose and mouth of the user;

c. said mask having an interior layer shaped cavity and an exterior shell having an outward side, edge and inward side surrounding said interior shaped cavity, where said interior forms a layer shaped cavity having a uniform thickness which is approximately $\frac{3}{8}$ inch, and said exterior has an elastic outward side, an edge having a uniform width which is approximately $\frac{5}{8}$ inch and an inward side with a very smooth surface;

d. said layer shaped cavity is inflated with liquid capable of transmitting vibrational waves;

e. said vibrating means including a pair of electric oscillators, a pair of mounting members, a pair of wires and a power unit with a switch, where the pair of electric oscillators is mounted on said elastic outward side of the exterior of said mask by the pair of mounting members at respective locations corresponding to the cheekbone area of the face of the user, and connected to the power unit by the pair of wires respectively; and f. said wearing means is attached to said edge of the exterior of said mask at two opposite locations for holding said mask firmly against the face of the user such that said smooth surface of the inward side of the exterior of said mask is in smooth contact with the entire area of the face of the user;

g. whereby vibration generated by said pair of electric oscillators with sonic frequencies ranging from 10 Hertz to 60 Hertz is transmitted by said liquid contained within said layer shaped cavity in the form of liquid waves to said inward side and slightly damped, then through said smooth surface of the inward side to stimulate the entire superficial blood capillary system of the face of the user.

7. The invention as defined in claim 6 wherein said mask is made of neoprene material.

8. The invention as defined in claim 6 wherein said power unit is a 3 volts rechargeable battery unit.

9. The invention as defined in claim 6 wherein said liquid is vegetable oil.

10. The invention as defined in claim 6 wherein said wearing means is an elastic strap which is approximately 1 foot long.

11. A vibrational liquid-wave stimulating therapy mask apparatus for facial health and beauty care comprising:

a. a molded unitary mask made of elastic material, a vibrating means and a wearing means;

b. said mask configured to substantially conform the general facial contour of a human face and completely cover the entire face of a user with openings corresponding to the respective locations and sizes of the eyes, nose and mouth of the user;

c. said mask having an interior layer shaped cavity and an exterior shell having an outward side, edge and inward side surrounding said interior shaped cavity, where said interior forms a layer shaped cavity having a uniform thickness, and said exterior has an elastic outward side and an inward side with a very smooth surface;

d. said layer shaped cavity inflated with liquid capable of transmitting vibrational waves;

e. said vibrating means connected to said elastic outward side of the exterior of said mask; and f. said wearing means attached to said mask for holding said mask firmly against the face of the user such that said smooth surface of the inward side of the exterior of said mask is in smooth contact with the entire area of the face of the user;

g. whereby vibration generated by said vibrating means is transmitted by said liquid contained within said layer shaped cavity in the form of liquid waves to said inward side and slightly damped, then through said smooth surface of the inward side to stimulate the entire superficial blood capillary system of the face of the user.

12. The invention as defined in claim 11 wherein said mask is made of neoprene material.

13. The invention as defined in claim 11 wherein said liquid is water.

14. The invention as defined in claim 11 wherein said wearing means is an elastic strap.

15. A vibrational liquid-wave stimulating therapy mask apparatus for facial health and beauty care comprising:

a. a unitary mask made of elastic material, and a vibrating means;

b. said mask configured to substantially conform the general facial contour of a human face and completely cover the entire face of a user with openings corresponding to the respective locations and sizes of the eyes, nose and mouth of the user;

c. said mask having an interior layer shaped cavity and an exterior shell having an outward side, edge and inward side surrounding said interior shaped cavity, where said interior forms a layer shaped cavity having a uniform thickness, and said exterior has an elastic outward side and an inward side with a very smooth surface contacting the entire area of the face of the user;

d. said layer shaped cavity is inflated with liquid capable of transmitting vibrational waves; and e. said vibrating means connected to said elastic outward side of the exterior of said mask;

f. whereby vibration generated by said vibrating means is transmitted by said liquid contained within said layer shaped cavity in the form of liquid waves to said inward side and slightly damped, then through said smooth surface of the inward side to stimulate the entire superficial blood capillary system of the face of the user.

16. The invention as defined in claim 15 wherein said mask is made of neoprene material.

17. The invention as defined in claim 15 wherein said liquid is vegetable oil.

18. The invention as defined in claim 15 wherein said liquid is water.

* * * * *